US007232010B2

(12) United States Patent
Woller et al.

(10) Patent No.: US 7,232,010 B2
(45) Date of Patent: Jun. 19, 2007

(54) MODULAR HUNTING LADDER

(75) Inventors: Ronald R. Woller, Decatur, AL (US); Scott Echols, Eva, AL (US)

(73) Assignee: Summit Treestands, LLC, Decatur, AL (US)

( * ) Notice: Subject to any disclaimer, the term of this patent is extended or adjusted under 35 U.S.C. 154(b) by 93 days.

(21) Appl. No.: 10/777,613

(22) Filed: Feb. 12, 2004

(65) Prior Publication Data

US 2005/0178615 A1 Aug. 18, 2005

(51) Int. Cl.
*E06C 1/00* (2006.01)

(52) U.S. Cl. ..... 182/116; 182/178.2

(58) Field of Classification Search ..... 182/116, 182/178.2–178.4, 151, 100, 93
See application file for complete search history.

(56) References Cited

U.S. PATENT DOCUMENTS

| | | | | | |
|---|---|---|---|---|---|
| 591,418 | A | | 10/1897 | Noyes | |
| 1,005,032 | A | | 10/1911 | Hennessee | |
| 1,231,037 | A | | 6/1917 | McGaffee | |
| 2,296,336 | A | * | 9/1942 | Crozier | 405/251 |
| 2,552,630 | A | * | 5/1951 | Hutchinson | 182/194 |
| 2,810,504 | A | | 10/1957 | Pula | |
| 3,598,201 | A | | 8/1971 | Thurmond | |
| 3,703,939 | A | * | 11/1972 | Maxwell | 182/107 |
| 3,961,688 | A | | 6/1976 | Starkey | |
| 4,069,892 | A | | 1/1978 | Lynne et al. | |
| 4,258,828 | A | | 3/1981 | Evans | |
| 4,261,436 | A | * | 4/1981 | Stillman, Jr. | 182/194 |
| 4,411,335 | A | | 10/1983 | Forrester | |
| 4,422,527 | A | | 12/1983 | Schultz et al. | |
| 4,552,246 | A | | 11/1985 | Thomas | |
| 4,674,597 | A | | 6/1987 | Humphrey | |
| 4,844,207 | A | | 7/1989 | Andrews et al. | |
| 4,892,170 | A | | 1/1990 | O'Donnell | |
| 4,953,662 | A | | 9/1990 | Porter | |
| 5,040,635 | A | | 8/1991 | Strickland | |
| 5,080,193 | A | | 1/1992 | Woof | |
| 5,086,873 | A | | 2/1992 | George | |
| 5,109,954 | A | | 5/1992 | Skyba | |
| 5,275,257 | A | * | 1/1994 | Robertson | 182/116 |
| 5,277,273 | A | | 1/1994 | Grimes | |
| 5,439,072 | A | | 8/1995 | Jenkins, Jr. | |
| D394,715 | S | | 5/1998 | Pearson | |
| 5,752,580 | A | | 5/1998 | Jenkins, Jr. | |

(Continued)

FOREIGN PATENT DOCUMENTS

FR 2620164 A1 * 3/1989

*Primary Examiner*—Alvin Chin-Shue
(74) *Attorney, Agent, or Firm*—Gardner Groff Santos & Greenwald PC

(57) ABSTRACT

A hunting ladder for attachment to a tree or pole includes a plurality of ladder sections that can be assembled together to form a rigid structure, including side rails and rungs extending between the side rails. In an exemplary embodiment, the side rails comprise elongate structural beams. External bolsters, shaped to match and closely abut the structural beams and adapted to be mounted to the outside of adjacent ladder sections, couple the ladder sections together. Fasteners extendable through the side bolsters and the structural beams allow adjacent ladder sections to be coupled together and uncoupled, as desired. In an exemplary embodiment, a seat is attached to an upper portion of the ladder without requiring attachment of the seat to the tree or pole.

9 Claims, 7 Drawing Sheets

U.S. PATENT DOCUMENTS

| | | | | |
|---|---|---|---|---|
| 5,816,362 | A | 10/1998 | Jenkins, Jr. | |
| D417,011 | S | 11/1999 | Woller, Sr. et al. | |
| D420,147 | S | 2/2000 | Woller, Sr. et al. | |
| 6,053,278 | A * | 4/2000 | Myers | 182/20 |
| 6,170,609 | B1 | 1/2001 | Dech | |
| 6,334,508 | B1 * | 1/2002 | Shields | 182/116 |
| 2002/0112919 | A1 * | 8/2002 | Graham, Jr. | 182/116 |
| 2002/0166727 | A1 * | 11/2002 | Cramer et al. | 182/228.1 |

* cited by examiner

MODULAR HUNTING LADDER

FIELD OF THE INVENTION

The present invention relates generally to the field of climbing equipment, and more particularly to a modular hunting ladder.

BACKGROUND OF THE INVENTION

In the hunting industry, the average age of the hunter is increasing. The passion for hunting of this generation is not on the decline, and there is increasing concern about the declining physical abilities of hunters and for safety while hunting from an elevated platform. There are numerous hunting ladders that attempt to provide safe elevated platforms with an integral ladder for climbing. Conventional hunting ladders require a tree, utility pole or some other vertical column for support, as compared to freestanding tri-pods.

Some hunting ladders utilize a single metal tube (square or rectangular) for the column, which creates a major concern regarding the strength-to-weight ratio of the unit. Certainly the single column could be sized to facilitate a clear span from the ground to the point where the ladder connects to the tree, but then the unit becomes too heavy to be transported easily. As a result, it has become somewhat "standard" in the industry to add a brace from the mid-span of the ladder to a point on the tree to prevent the ladder column from collapsing as the user ascends. This makes the set-up of the unit more difficult because the user must adjust the brace for each particular tree diameter. Furthermore, as the user ascends the ladder above the brace connection point, the ladder has a tendency to "kick-out" at the bottom before the top can be securely attached to the tree. Therefore, this brace only adds to the complexity and cost of the system.

Other hunting ladders utilize a square or rectangular tube that incorporates an internal or external splice component, which allows adjacent sections to be connected. Such a design has several disadvantages. First, in order to make the adjacent sections relatively easy to assemble and disassemble, there must be a certain amount of clearance between the mating of male/female components. This clearance results in a non-stable, non-integral column after assembly. As this clearance is reduced, the unit becomes much more difficult to assemble and disassemble. Add to this the requirement that the mating sections be held perfectly parallel during the assembly process, and the task can become time consuming and frustrating.

By using an internal or external splice component to connect adjacent ladder sections without bolting the sections together, it is common to have separation of the ladder sections after assembly at the tree. Since most of these units are installed in late summer and early fall, the ground is usually dry and very firm. After the installer securely attaches the top of the ladder to the tree, it cannot move down the tree. Later in the year during hunting season, which is normally October through January, soil conditions are typically wet. As the user ascends the ladder, the bottom section can sink into the wet, softened soil, but the top section cannot move down the tree because it is securely attached to the tree. Consequently, the sections can separate, causing a catastrophic failure of the ladder column.

Some have attempted to address these shortcomings by fabricating a modular ladder column wherein each sidepiece of the ladder section has a pair of parallel square tubes connected together by a continuous W-W wire-form welded to the tubes. However, in such a design, adjacent sections are connected together with four sleeves, one sleeve for each of the four square tubes. While this design is structurally superior to the single-tube column design, it does not eliminate the tube-in-tube or tube-over-tube section jointing technique. Moreover, the four square tubes and the four sleeves must be held in perfect alignment for the adjacent sections to mate together, which adds to the difficultly of the assembly. Additionally, this is a terribly inefficient method to manufacture the column.

Steel tube fabrication has also proven inadequate because it is difficult to provide permanent non-skid ridges onto the ladder rungs for safety while climbing. Mud, snow and even water can cause the ladder rungs of most ladders to be dangerously slippery if the manufacturer does not add traction enhancing devices, such as adhesive-backed sandpaper or a metal strip with raised features to resist slipping.

Thus, it has been found that a need yet exists for an improved hunting ladder for attachment to a tree or pole, which ladder is safe in use, convenient, lightweight, easy-to-use, and easy to assemble. It is to the provision of such an improved hunting ladder meeting these and other needs that the present invention is primarily directed.

SUMMARY OF THE INVENTION

Briefly described, in an illustrative form the present invention comprises a hunting ladder for attachment to a tree or pole. The hunting ladder includes a plurality of ladder sections that can be assembled together to form a rigid structure. Each of the ladder sections includes side rails and rungs extending between the side rails. The side rails comprise elongate structural beams. Further, external side bolsters are adapted to be mounted to the inside or outside of adjacent ladder sections to couple the ladder sections together. The external side bolsters are shaped to match and closely abut the structural beams. Fasteners, extendable through the side bolsters and the structural beams, can be used to allow the adjacent ladder sections to be coupled together and uncoupled, as desired.

Preferably, a seat is attached to an upper portion of the ladder without requiring attachment of the seat to the tree or pole. Also preferably, the external side bolsters are removably attached to each of the adjacent ladder sections, or the external side bolsters are permanently or semi-permanently attached to one of the adjacent ladder sections and removably attached to the other adjacent ladder section.

In another form, the present invention comprises a modular hunting ladder for attachment to a tree or pole including at least two ladder sections that can be connected together to form a rigid structure. Each of the ladder sections includes two generally parallel side rails with rungs extending therebetween. The first ladder section has a seat attached only to the first ladder section. Preferably, the modular hunting ladder also comprises a platform secured only to the first ladder section for attachment to the tree or pole. Also preferably, the platform is attached to the first ladder section at point between the seat and a rung of the first ladder section.

The present invention provides a hunting ladder which is simple in construction, durable in use, inexpensive to manufacture, and easily transportable. The present invention also is easy to use, reliable, and safe and also can be assembled and disassembled quickly and easily.

These and other features and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
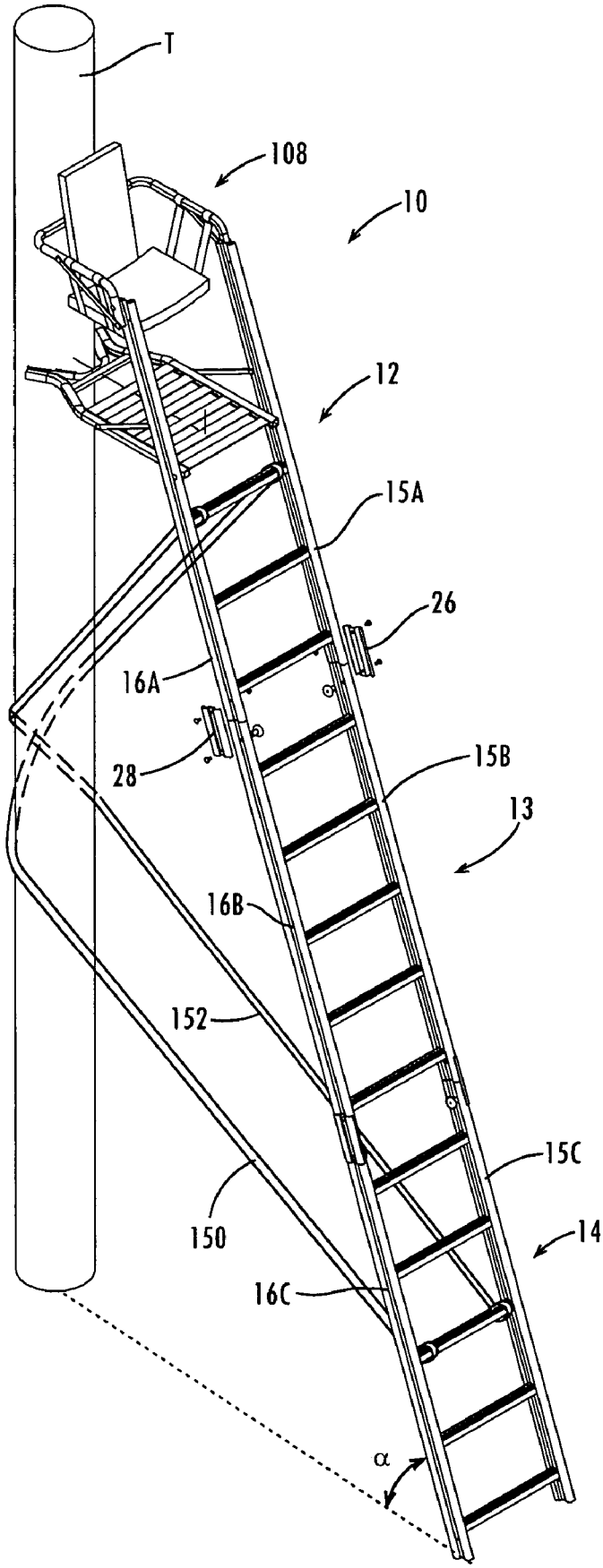
FIG. 1 is a perspective view of a hunting ladder according to an illustrative form of the present invention and shown attached to a tree.

Referring now to the drawing figures, in which like reference numbers refer to like parts throughout the several views, preferred forms of the present invention will now be described by way of example embodiments. It is to be understood that the embodiments described and depicted herein are only selected examples of the many and various forms that the present invention may take, and that these examples are not intended to be exhaustive or limiting of the claimed invention. Also, as used in the specification including the appended claims, the singular forms "a," "an," and "the" include the plural unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. Moreover, when describing the attachment of the ladder to a "tree" in the appended claims, it will be understood that this term "tree" encompasses poles as well as actual trees.

As shown in FIG. 1, the present invention comprises a hunting ladder 10, which is modular and includes multiple ladder sections, such as sections 12, 13, and 14. While three such sections are shown in this figure, those skilled in the art will recognize that fewer or more sections can be employed. Indeed, as contemplated in a unit to be sold commercially, the hunting ladder 10 would have two or three such sections. Preferably, three such sections, each six feet in length, are assembled together to form an 18-foot, rigid ladder that is intended to be leaned against the tree T at an angle $\alpha$. Preferably, the angle $\alpha$ is about 70-75°.

Figure 4A:
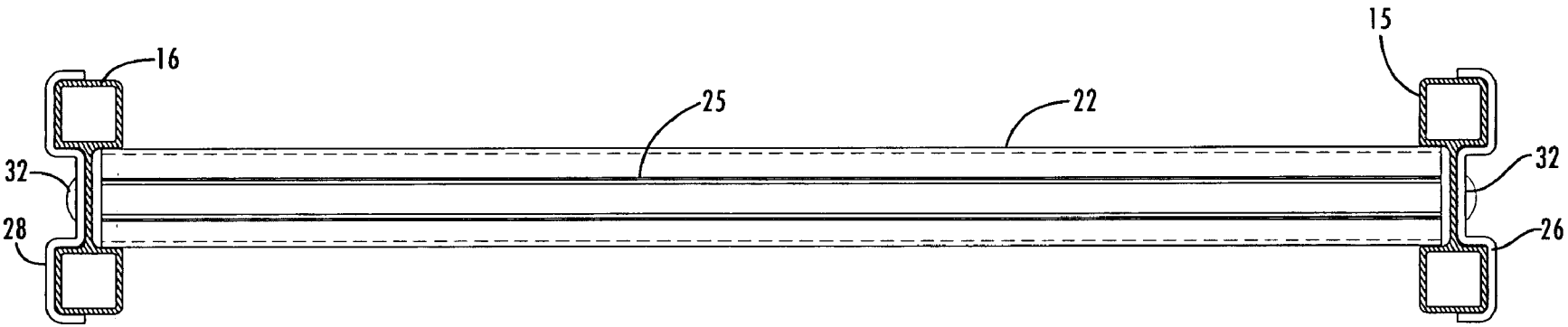
FIG. 4A is a sectional view of the hunting ladder of FIG. 1 taken along view lines 4A-4A of FIG. 3A.
Figure 4B:
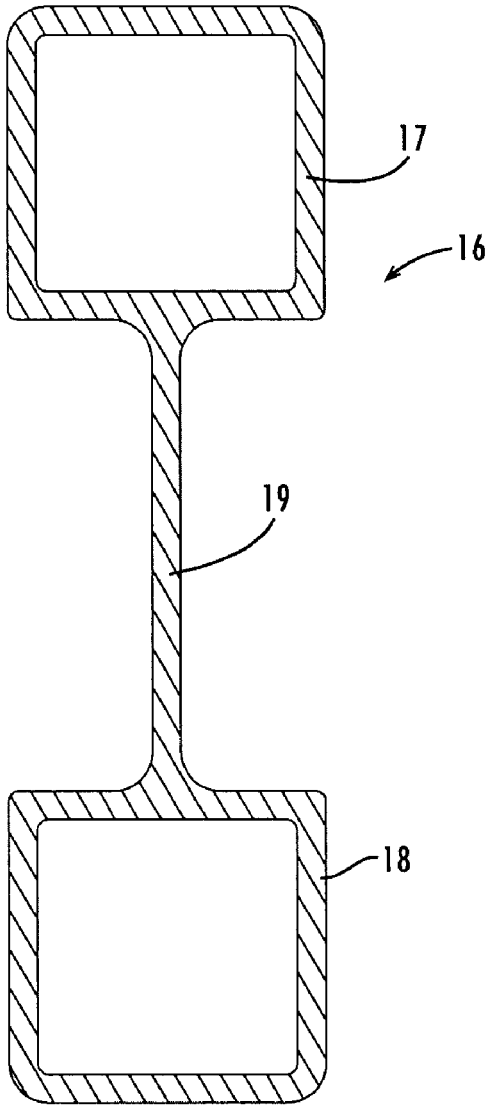
FIG. 4B is a sectional view of a side rail portion of the hunting ladder of FIG. 1 taken along view lines 4B-4B of FIG. 3B.

Each ladder section 12, 13, and 14 has side rails 15 and 16. Preferably, the side rails 15 and 16 are elongate structural beams. In one embodiment, the side rails 15 and 16 are double box I-beams having two box sections 17 and 18 and a web 19 extending therebetween. A cross-sectional view of the rail 15 having two box sections 17 and 18 and a web 19 extending therebetween is depicted in FIG. 4B.

Rungs 22 extend between the side rails 15 and 16. The rungs 22 each are broad enough to accommodate both feet of a user standing thereon at one time. In one embodiment, the rungs 22 are parallelogram-shaped such that their top surfaces 24 are generally parallel with the ground when the ladder is mounted to a tree. Preferably, each rung 22 has a top surface 24 which is oriented at an acute angle relative to the side rails 15 and 16. More preferably, the top surface 24 of each rung 22 is oriented at an angle of about 70° relative to the side rails 15 and 16. Alternatively, other shapes and orientations for the rungs 22 could be employed, as desired.

Preferably, the side rails 15 and 16 and the rungs 22 are made of extruded material. Preferably, the side rails 15 and 16 and the rungs 22 are all made from aluminum or other durable, lightweight material. Both the side rails 15 and 16 and the rungs 22 can be hollow. The thickness of the walls of the side rails 15 and 16 and the rungs 22 can be optimized to reduce the weight of the side rails and the rungs to a minimum while maximizing the strength of the ladder 10.

Figure 3A:
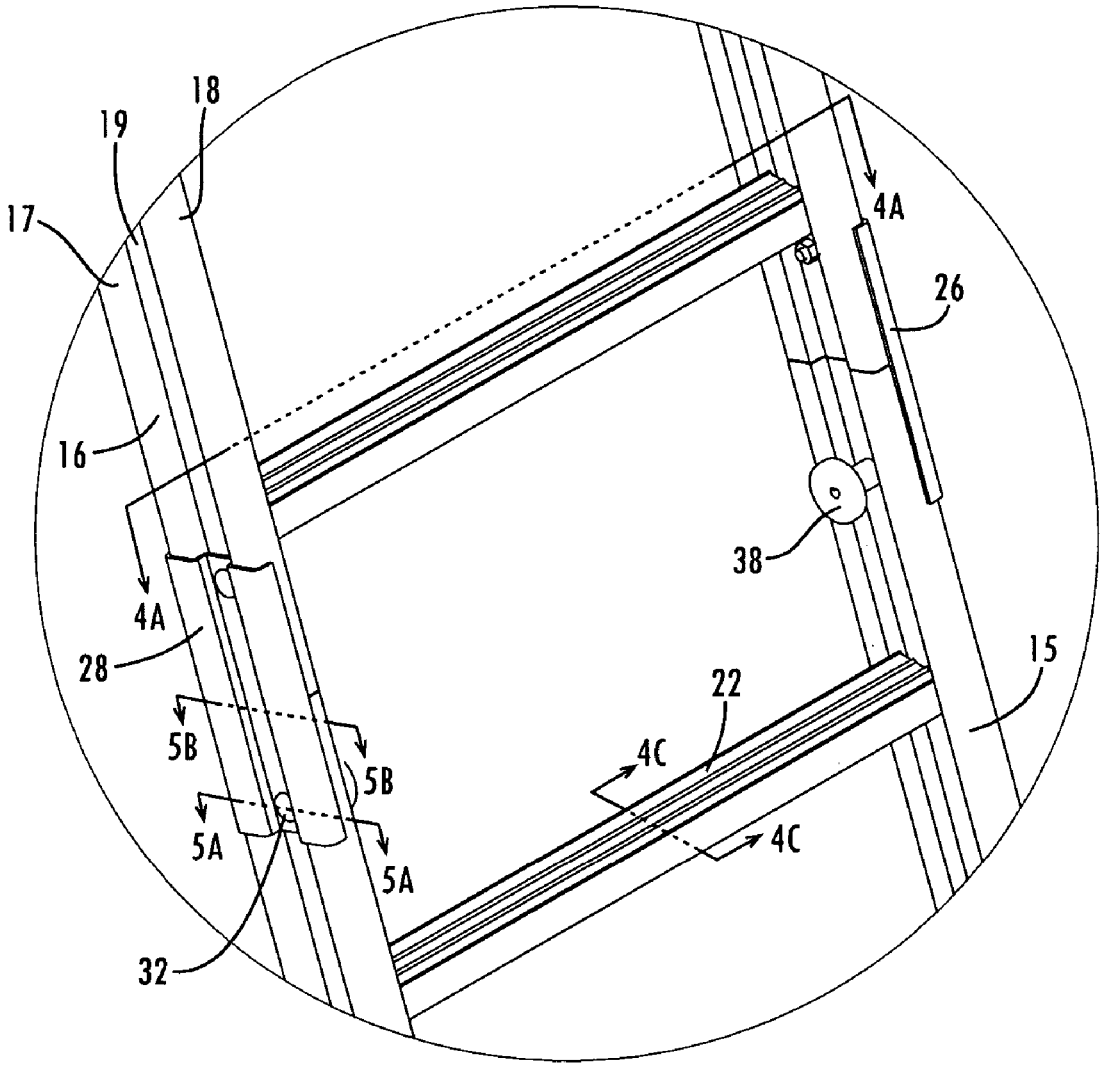
FIG. 3A is a detailed view of a portion of the ladder of FIG. 1, in particular, a pair of external side bolsters.
Figure 3B:
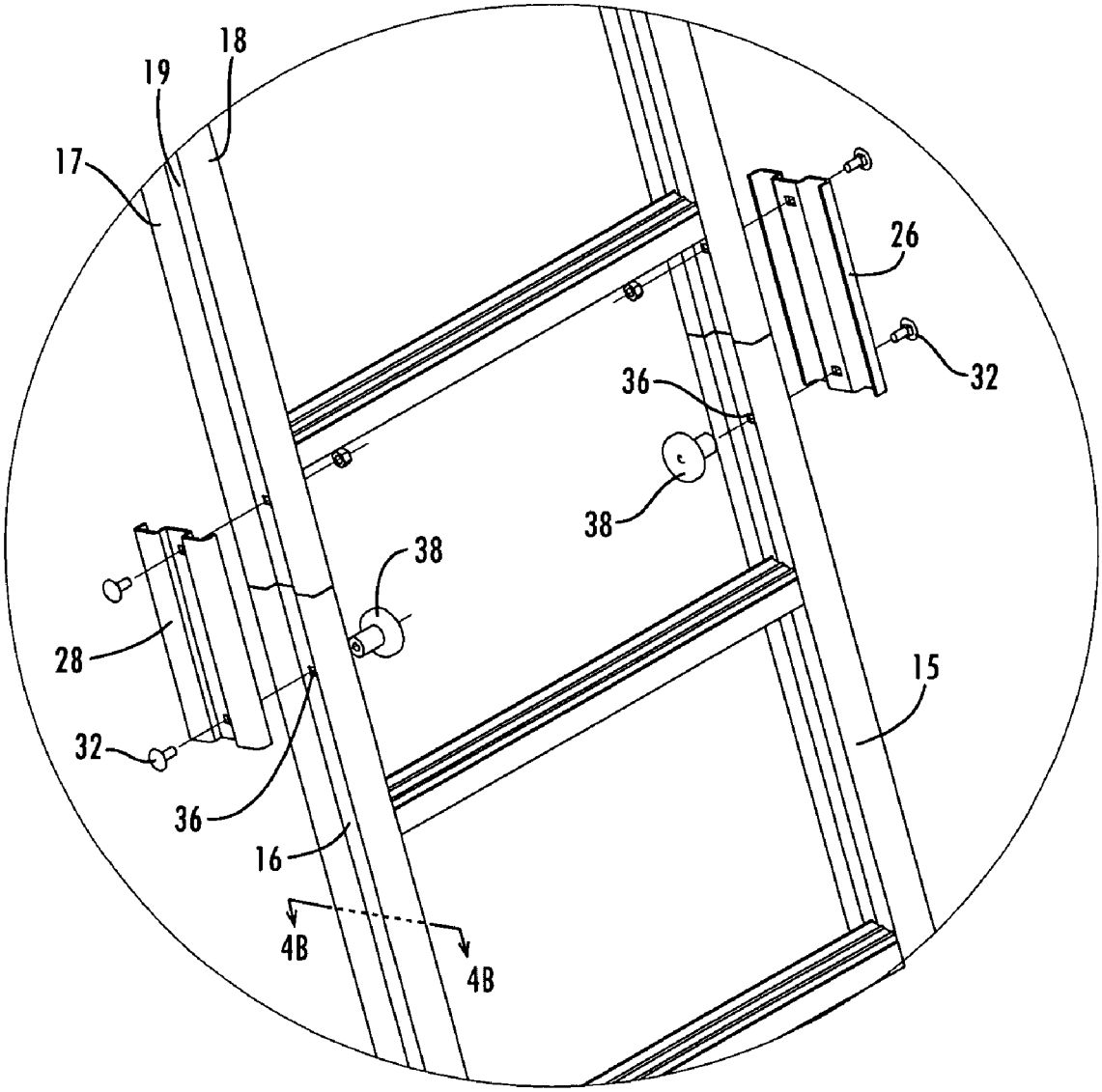
FIG. 3B is a detailed view of the external side bolsters of FIG. 3A prior to attachment to the hunting ladder of FIG. 1.
Figure 4C:
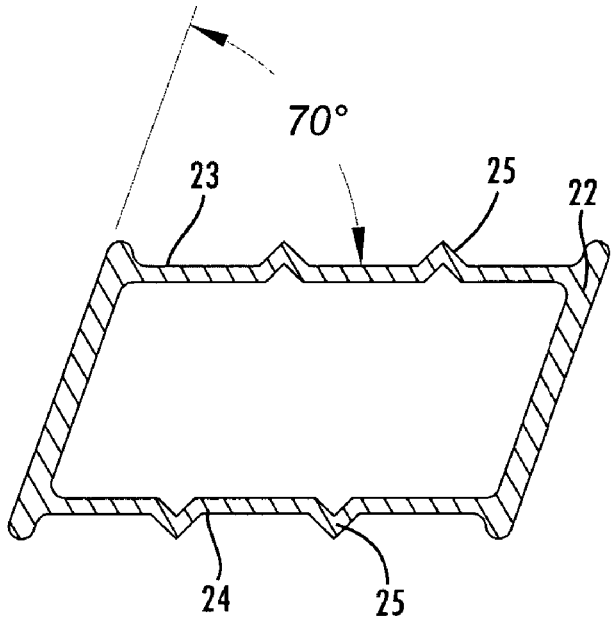
FIG. 4C is a sectional view of a rung portion of the hunting ladder of FIG. 1 taken along view lines 4C-4C of FIG. 3A.

Preferably, the top surfaces 23 and the bottom surfaces 24 of the rungs 22 have ridges 25 formed thereon for minimizing foot slippage, as best seen in FIGS. 3A, 3B, and 4C. For example, raised triangular-shaped ridges 25 can be incorporated on the top surfaces 23 of the rungs 22 to provide traction, which minimizes the user's foot slippage.

Figure 5A:
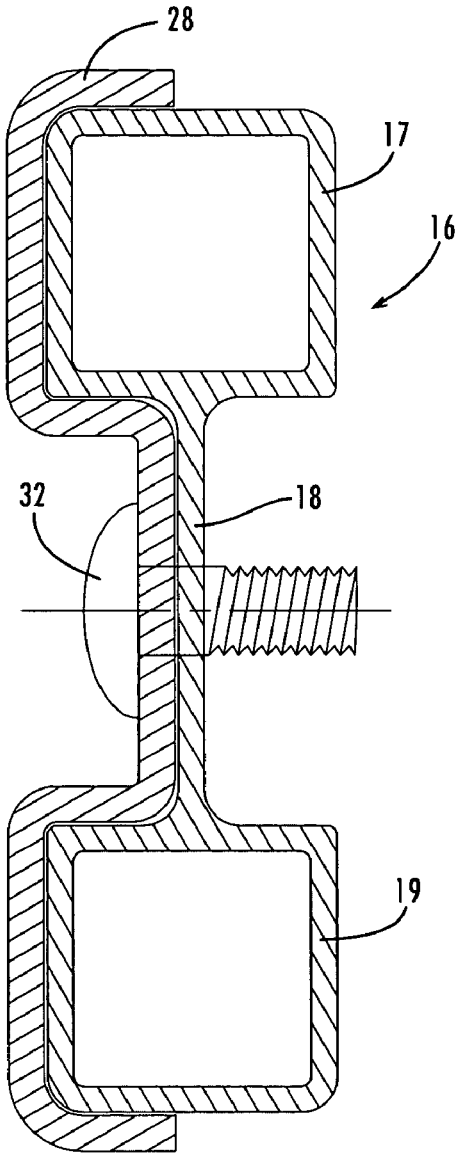
FIG. 5A is a sectional view taken along view lines 5A-5A of FIG. 3A of an external side bolster attached to the hunting ladder of FIG. 1.
Figure 5B:
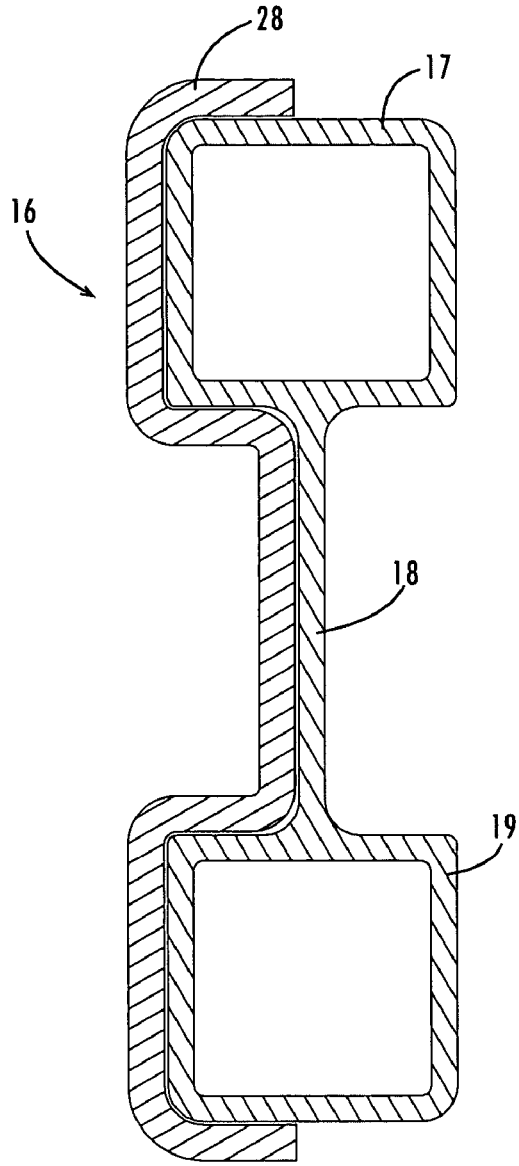
FIG. 5B is a sectional view taken along view lines 5B-5B of FIG. 3A of an external side bolster attached to the hunting ladder of FIG. 1.

As shown in FIGS. 1, 3A, and 3B, a pair of external side bolsters 26 and 28 is adapted to be mounted to the outside of adjacent ladder sections to couple the ladder sections together. Alternatively, side bolsters could be mounted to the inside of the ladder sections or to both the inside and the outside of the ladder sections. The external side bolsters 26 and 28 function to adjoin adjacent ladder sections, while providing strength and rigidity in order for the hunting ladder 10 to function as one homogenous unit. Preferably, the external side bolsters 26 and 28 are shaped to match and closely abut the side rails 15 and 16. Even more preferably, the external side bolsters 26 and 28 are constructed of extruded aluminum and have shapes that mate together with the side rails 15 and 16 with a precision fit. In such an embodiment, the side bolsters 26 and 28 are not flat, but rather the side bolsters follow the contours of the side rails 15 and 16, which in the illustrated embodiment are double box I-beams. Thus, the external side bolsters 26 and 28 closely overlay the double box I-beams, including the webs 19 and the box sections 17 and 18. Additionally, the side bolsters 26 and 28 wrap around distal edges of the box sections 17 and 18 of the I-beams. A cross-sectional view of the external side bolster 26 overlaying side rail 16 is shown in FIG. 5B.

In the exemplary embodiment depicted, the external side bolsters 26 and 28 contact only the outer portions of the side rails 15 and 16. Thus, the external side bolsters 26 and 28 and the side rails 15 and 16 can mate together with a precision fit while being fully capable of withstanding bending moments experienced by the hunting ladder 10 induced in the areas where adjacent ladder sections are connected.

Below is a description relating to the external side bolster 28 for coupling the side rail 16A of the first ladder section 12 to the side rail 16B of the second ladder section 13. It will be understood that the third ladder section 14 is coupled to the second ladder section 13 with an identical external side bolster 28. Moreover, external side bolsters 26 are identical to external side bolsters 28, only their orientation on the hunting ladder 10 differs.

The external side bolster 28 has an opening 34 therethrough for insertion of a fastener 32. The fastener 32 permits adjacent ladder sections to be coupled together and uncoupled, as desired. Preferably, the fastener 32 is a carriage bolt and the opening 34 through the side bolster 28 is square-shaped. The fastener 32 couples the first ladder section 12 to the second ladder section 13 by extending through the opening 34 of the side bolster 28 and through an opening 36 of the side rail 16. To attach the fastener 32 to the side bolster 28 and the ladder section 12, a threaded hand knob 38 is used in combination with the fastener 32. FIG. 5A depicts a cross sectional view of the fastener 32 inserted through the external side bolster 28 and the rail 16. However, it is to be understood that the fastener 32 is to be secured to the side rail 16, even though for clarity of illustration, the threaded hand knob 38 is omitted from FIG. 5A. The threaded hand knob 38 can be a plastic knob with a metal insert that is configured to receive the threaded end of the fastener 32. By using the threaded hand knob 38, the need for additional tools is eliminated. However, those skilled in the art will appreciate that other fasteners, including those requiring an additional tool(s), can be used without departing from the scope of the present invention.

The external bolster 28 can be removably attached to the adjacent ladder sections 12 and 13. Alternatively, the external side bolster 28 can be permanently attached, such as by welding, or semi-permanently attached, such as with a bolt and locknut, or mounted to one ladder section, for example ladder section 12, and removably attached or mounted to another ladder section, for example ladder section 13, in a manner described above.

Figure 2:
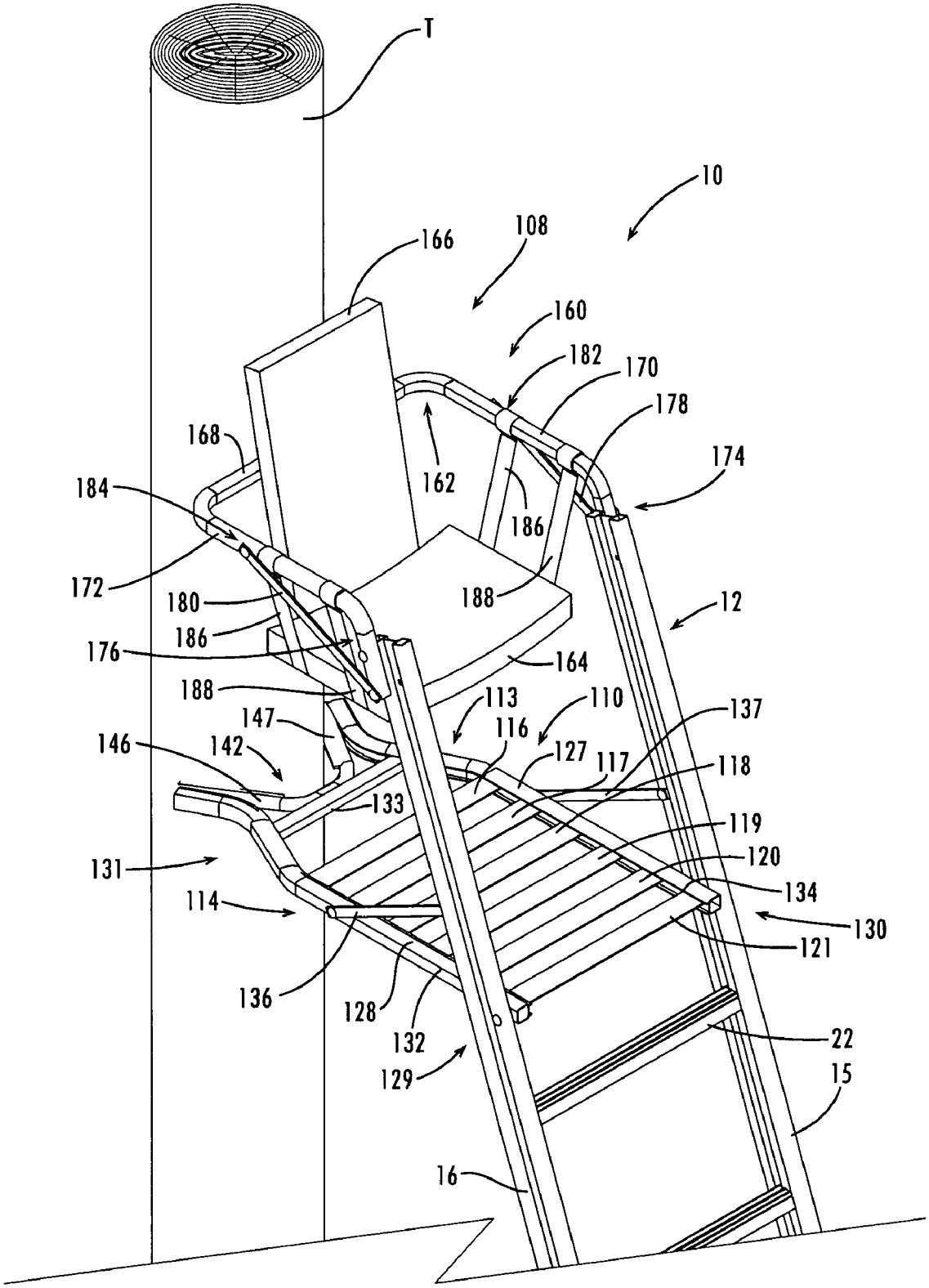
FIG. 2 is an enlarged perspective view of an upper portion of the hunting ladder of FIG. 1.

As shown in FIGS. 1 and 2, the hunting ladder 10 includes an upper portion 108 having a rigid platform structure 110 for attaching to the tree T and a tree seat 160. The rigid platform structure 110 includes a platform assembly indicated at 113. The platform assembly 113 includes a peripheral frame assembly 114 and a series of slats, such as slats 116-121. The peripheral frame assembly 114 also includes side frame members 127 and 128, as well as a generally U-shaped platform frame 131. The side frames 127 and 128 are connected to the side rails 15 and 16 of the first ladder section 12 in the vicinity of regions 129 and 130.

The U-shaped platform frame 131 includes two portions which lie adjacent the plane of the platform assembly 113, namely portions 133 and 134. Moreover, the U-shaped platform frame 131 also includes two support posts 136 and 137 for supporting the platform 113 adjacent the hunting ladder 10. As best seen in FIG. 2, the support posts 136, 137 are oriented at an acute angle with respect to the remainder of the platform 113.

A generally V-shaped yoke 142 is positioned beneath the U-shaped vertical frame 141, is welded thereto, and faces away from the platform assembly 113. The yoke 142 is adapted for at least partly straddling the tree and will be described in more detail below.

The frame components just described can be made from 18 gauge steel tubing, 13/16 inches square (or other materials). The individual pieces thereof can be welded together and then powder coated (painted) to avoid corrosion.

Referring again to the generally V-shaped yoke 142 of FIG. 2, the yoke includes tubular sections 146 and 147. Preferably, the inside faces of the tubular sections 146, 147 are provided with a scalloped sill to help grip the tree and to avoid slippage in use. The first and second tubular sections 146 and 147 are each oriented at an angle of 56° with respect to the U-shaped vertical frame 141. As a result, the included angle between the tubular sections 146 and 147 is 68°. It has been found that this angle is particularly effective for engaging a tree and results in the yoke at least partly straddling the tree over a wide range of diameters, including trees having diameters between about 8" and slightly more than 20". Applicants have also found that an included angle of about 72° works very well too.

The rigid platform structure 110 is firmly secured to the tree using a pair of flexible crossing straps 150 and 152 attached to the hunting ladder 10. Preferably, the straps 150 and 152 attach to a rung 22 of the bottom ladder section 14 in the vicinity of regions 154 and 155. The straps 150 and 152 can be permanently attached to the bottom ladder section 14, or the straps can be removably attached to the bottom ladder section 14. As the user ascends the ladder, the user crosses the straps around the backside of the tree and attaches them to a rung 22 of the top ladder section 12 in the vicinity of regions 156 and 157, which is located generally below the platform structure 110. Preferably, the straps 150 and 152 comprise a length of nylon webbing. Alternatively, other types of flexible mounting elements could be employed. Those skilled in the art will also recognize that a cable, chain, rope, belt or other flexible mounting element could be employed as desired.

As also shown in FIGS. 1 and 2, the upper portion 108 of the hunting ladder 10 includes a tree seat 160. The tree seat 160 is shown attached to the hunting ladder 10 and positioned near the tree trunk. The tree seat 160 includes a frame assembly indicated generally at 162. A seat bottom 164 is suspended from beneath the frame assembly 162 and a substantially upright seat back 166 extends upwardly from the seat bottom 164.

The frame assembly 162 includes a transverse intermediate portion 168 and arm portions 170 and 172. The arm portions 170 and 172 can function as handrails to be used by the user while standing and turning around on the standing platform 110. The distal ends of the arm portions 170 and 172 curve generally downwardly to engage a proximal end of the first ladder section 12. The arm portions 170 and 172 are secured to the hunting ladder 10 in the vicinity of regions 174 and 176. A pair of support arms 178 and 180 is secured to the arm portions 170 and 172 in the vicinities of 174 and 182 and 176 and 184.

The seat bottom 164 is suspended from the arm portions 170 and 172 by two pieces of webbing, webbing 186 and webbing 188. The webbings 186 and 188 are attached loosely to the underside of the seat bottom 164 by being threaded through an opening formed between strappings sewn to the underside of the seat bottom 164. Each of the webbings 186 and 188 has a loop sewn at each of its ends and acts as a sling to support the padded seat bottom 164. Thus, as depicted in the figures, the frame assembly 162 is cantilevered from a proximal end of the hunting ladder 10, which provides a tree seat 160 suspended from the frame assembly without the need to attach the seat frame assembly to the tree.

The seat bottom 164 and the upright seat back 166 include inner padding material covered with fabric, such as camouflage fabric. Moreover, the seat bottom 164 and the upright seat back 166 are made from two separate pieces of padding, which are covered with a single sewn-on cover so that the seat bottom and the seat back are connected to each other flexibly.

While the invention has been shown and described in preferred forms, it will be apparent to those skilled in the art that many modifications, additions, and deletions can be made therein. These and other changes can be made without departing from the spirit and scope of the invention as set forth in the following claims.

We claim:

1. A hunting ladder for attachment to a tree or pole, comprising:

a plurality of ladder sections that can be assembled together to form a rigid structure, including side rails and rungs extending between the side rails, the side rails comprising elongate structural beams, wherein the structural beams comprise double box I-beams having two box sections and a web extending therebetween;

external side bolsters adapted to be mounted to the outside of adjacent ladder sections to couple the ladder sections together, the external side bolsters being shaped to match and closely abut the structural beams, wherein the external side bolsters are permanently or semi-permanently mounted to one ladder section and can be removably mounted to an adjacent ladder section, wherein the side bolsters closely overlay the contours of the double box i-beams, including the web and the two box sections and wrap around distal edges of the box section, and wherein the structural beams and the external side bolsters have shapes that mate together; and fasteners extendable through the side bolsters and the structural beams to allow the adjacent ladder sections to be coupled together and uncoupled, as desired.

2. A hunting ladder as claimed in claim 1 further comprising a seat attached to an upper portion of the ladder without requiring attachment of the seat to the tree or pole.

3. A hunting ladder as claimed in 1 wherein the plurality of ladder section comprises three ladder sections.

4. A hunting ladder as claimed in claim 1 wherein the adjacent ladder sections can be coupled together without tools.

5. A hunting ladder as claimed in claim 4 wherein the fasteners comprise threaded hand knobs.

6. A hunting ladder as claimed in claim 1 wherein the external side bolsters are removably attached to each of the adjacent ladder sections.

7. A hunting ladder as claimed in claim 1 wherein the rungs have a top surface which is oriented at an acute angle relative to the side rails.

8. A hunting ladder as claimed in claim 1 wherein the side rails comprise extruded aluminum and the rungs comprise extruded aluminum, with ridges formed in a top portion of the rungs for minimizing foot slippage.

9. A hunting ladder as claimed in claim 1 wherein the structural beams and the side bolsters mate together with a precision fit.

* * * * *